US005481066A

United States Patent [19]

Kitamura

[11] Patent Number: 5,481,066

[45] Date of Patent: Jan. 2, 1996

[54] AUTOMATIC PERFORMANCE APPARATUS FOR STORING CHORD PROGRESSION SUITABLE THAT IS USER SETTABLE FOR ADEQUATELY MATCHING A PERFORMANCE STYLE

[75] Inventor: Minoru Kitamura, Hamamatsu, Japan

[73] Assignee: Yamaha Corporation, Hamamatsu, Japan

[21] Appl. No.: 168,068

[22] Filed: Dec. 15, 1993

[30] Foreign Application Priority Data

Dec. 17, 1992 [JP] Japan ..... 4-337660

[51] Int. Cl.[6] ..... G10H 7/00; G10H 1/38

[52] U.S. Cl. ..... 84/637; 84/613

[58] Field of Search ..... 84/613, 637, 669, 84/DIG. 22

[56] References Cited

U.S. PATENT DOCUMENTS

| | | | |
|---|---|---|---|
| 4,327,622 | 5/1982 | Aoki . | |
| 5,052,267 | 10/1991 | Ino | 84/613 |
| 5,085,118 | 2/1992 | Sekizuka | 84/635 |
| 5,218,153 | 6/1993 | Minamitaka | 84/613 |
| 5,302,776 | 4/1994 | Jeon et al. | 84/613 |

*Primary Examiner*—William M. Shoop, Jr.

*Assistant Examiner*—Jeffrey W. Donels

*Attorney, Agent, or Firm*—Loeb & Loeb

[57] ABSTRACT

In order to play an automatic performance based on performance information which is stored in a storage device and the like in advance, an electronic musical instrument provides an automatic performance apparatus. The automatic performance apparatus is configured by a performance style designating portion, a storage portion, a read-out portion and an automatic performance portion. The performance style designating portion designates a desired performance style within a plurality of performance styles, each of which corresponds to a specific music genre such as rock music, jazz and pop music. The storage portion, such as a read-only memory, stores a plurality of chord progression patterns with respect to each of the performance styles. The read-out portion accesses the storage portion to automatically read out one of the chord progression patterns concerned with the desired performance style which is designated by the performance style designating portion. Herein, each of the chord progression patterns is given a specific priority, so that a certain chord progression pattern given a higher priority is selectively read out from the storage portion. Then, the automatic performance portion, which is configured by a tone generator and a sound system, plays an automatic performance in accordance with the chord progression pattern which is read from the storage portion by the read-out portion.

12 Claims, 10 Drawing Sheets

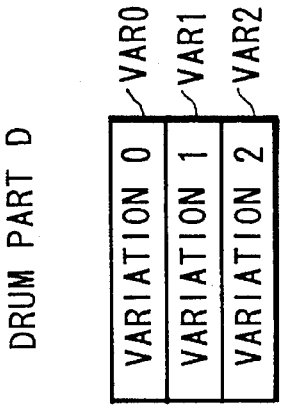
FIG.3(A)
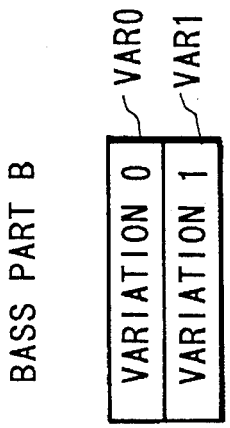
FIG.3(C)
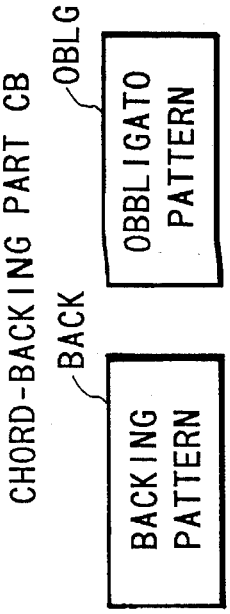
FIG.3(E)
FIG.3(B)
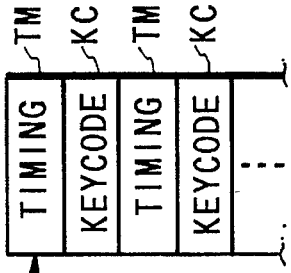
FIG.3(D)
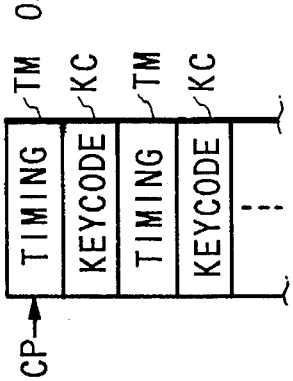
FIG.3(F)
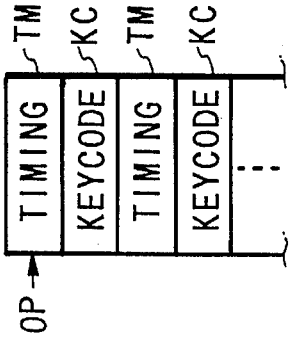
FIG.3(G)

CHORD-PROGRESSION PATTERN CHP

| | |
|---|---|
| MAJOR CHORD PROGRESSION | MAJ |
| MINOR CHORD PROGRESSION | MIN |

PR(STYL;ORD)

| STYL | STYLE \ ORD | ORD (0) | ORD (1) |
|---|---|---|---|
| 0 | DANCE | MINOR | MAJOR |
| 1 | HARD ROCK | MINOR | MAJOR |
| 2 | POP ROCK | MAJOR | MINOR |
| | | | |

MAJOR: "0"

MINOR: "1"

| NO. | STYLE NAME | MAJ/MIN | PRIORITY | 1 | | 2 | | 3 | | 4 | | 5 | | 6 | | 7 | | 8 | |
|---|---|---|---|---|---|---|---|---|---|---|---|---|---|---|---|---|---|---|---|
| 1 | DANCE | MAJOR | 2 | C7 | | | | | | | | Bb7 | | | | | | Bm7 | |
| | (MIN) | MIN | 1 | Cm7 | | | | | | | | Fm7 | | | | | | | |
| 2 | HARD ROCK | MAJOR | 2 | C | | Bb | | C | | Bb | | C | | Bb | | C | | Bb | |
| | (MIN) | MIN | 1 | Cm | | | | | | | | Gm | | Fm | | Cm | | Gm | |
| 3 | POP ROCK | MAJOR | 1 | C | | | | Am | | | | F | | | | G7 | | Gsus4 | G7 |
| | | MIN | 2 | Cm | | G# | | Bb | | Eb | | G | | Cm | | Fm | | G7 | |
| 4 | SLOW ROCK | MAJOR | 1 | C | | Am | | Dm | | G7 | | Em | | Am | | Dm | G7 | C | |
| | | MIN | 2 | Cm | | Fm | | D7 | | G | | Cm | | Fm | | G7 | | Cm | |
| 5 | FUNK | MAJOR | 2 | CM7 | | C#M7 | | CM7 | | C#M7 | | CM7 | | C#M7 | | CM7 | | C#M7 | |
| | (MIN) | MIN | 1 | Cm7 | | Fm7 | | Eb | | Gm7 | | Fm7 | | | Gm7 | Cm7 | | | C#m |
| 6 | SWING | MAJOR | 1 | C | | | | E | | | | FM7 | | G | | C | | F | G |
| | | MIN | 2 | G# | | Bb | | Eb | | Cm | | Fm7 | | G | | Cm | | | |
| 7 | BOSSA NOVA | MAJOR | 1 | CM7 | | | | Dm7 | | | | | | G7 | | CM7 | | C#M7 | |
| | | MIN | 2 | Cm | | | Bb | G#M7 | | | Bb | Cm | | | Bb | G#M7 | | | G7 |
| 8 | SAMBA | MAJOR | 1 | C | | | | Am | | Am7 | | F | | Fm | | Dm7 | | Gsus4 | G7 |
| | | MIN | 2 | Cm | | | | Eb | | | | G# | | | | Bb | | G7 | |
| 9 | TANGO | MAJOR | 1 | C | | | | | | | | Am | | G | | F | Fm | C | |
| | | MIN | 2 | Cm | | | | | | | | Fm | | | | | | | |
| 10 | MARCH | MAJOR | 1 | C | | | | | | | | Am | | | | Dm7 | | G7 | |
| | | MIN | 2 | Cm | | | | Eb | | | | Fm | | | | Eb | | G7 | |
| 11 | WALTZ | MAJOR | 1 | C | | | | CM7 | | C | | F | | | | FM7 | | F | |
| | | MIN | 2 | Cm | | Fm | | Cm | | Cm7 | | Fm | | G#m | | Fm | | G7 | |
| 12 | FANFARE | MAJOR | 1 | C | | | | | | | | F | | | | C | | | |
| | | MIN | 2 | Cm | | | | | | | | Fm | | | | Cm | | | |

FIG.11

AUTOMATIC PERFORMANCE APPARATUS FOR STORING CHORD PROGRESSION SUITABLE THAT IS USER SETTABLE FOR ADEQUATELY MATCHING A PERFORMANCE STYLE

BACKGROUND OF THE INVENTION

Field of the Invention

The present invention relates to an automatic performance apparatus which is capable of automatically performing a musical tune by reproducing performance information which is stored in a storage device and the like In advance.

Prior Art

Recently, a chord sequencer has been known as an automatic performance apparatus. This chord sequencer can play an automatic performance In accordance with a progression of chords which is designated by the user. The chord sequencer utilizes chord sequence data (or chord progression data) containing a plurality of chord data which are arranged in accordance with a progression of the musical tune to be played. The chord sequence data are sequentially read out at a predetermined tempo, so that a plurality of chord data are eventually read out, by which an automatic performance is played. Herein, each chord data is made of two kinds of data representing a root of chord and a kind of chord respectively. This chord data is information designating the chord to be produced. The chord sequence data is formed by the chord data and other data representing a time length during which the chord data is designated.

When playing an automatic performance, or in other words, when reproducing performance patterns which are stored in the storage device and the like in advance, the chord sequencer alters a tone pitch (i.e., keycode) of each of the notes forming the performance pattern in accordance with the chord data representing the root of chord and kind of chord. Herein, the performance pattern is formed by data representing the tone pitch of each note to be generated and its tone-generation timing. As an accompaniment performance, a so-called chord backing pattern or a bass pattern is employed. In the chord backing pattern performance, accompaniment sounds belonging to an intermediate tone area (i.e., a frequency range to which intermediate tone pitches belong) are mainly used. In the bass pattern performance, accompaniment sounds belonging to a lower tone area (i.e., a frequency range to which lower tone pitches belong) are mainly used.

Meanwhile, each music genre such as the rock music, jazz and pop music has its own specific performance style which is supported by the specific chord-progression pattern. So, if the chord progression is automatically produced, regardless of the chord-progression pattern unique to each performance style, the automatic performance would become unnatural in terms of the musical sense. Therefore, the conventional automatic performance apparatus is designed such that the chord data must be inputted thereto in accordance with a progression of the tune so as to make a progression of chords. However, if the user is a beginner or the user lacks a detailed knowledge of chords, it is difficult to make a progression of chords which is adequate to the performance style. In short, the conventional apparatus is disadvantageous in that the automatic performance cannot be played well with ease.

SUMMARY OF THE INVENTION

Accordingly, it is an object of the present invention to provide an automatic performance apparatus to which the user can easily set a progression of chords adequate to the desired performance style.

According to the present invention, an automatic performance apparatus is fundamentally configured by a performance style designating portion, a storage portion, a read-out portion and an automatic performance portion. The performance style designating portion is provided to designate a desired performance style within a plurality of performance styles. The storage portion stores a plurality of chord progression patterns with respect each of the performance styles. The read-out portion accesses to the storage portion so as to read out one of the chord progression patterns concerned with tile desired performance style which is designated by the performance style designating portion. The automatic performance portion plays an automatic performance in accordance with the chord progression pattern which is read from the storage portion by the read-out portion.

BRIEF DESCRIPTION OF THE DRAWINGS

Further objects and advantages of the present invention will be apparent from the following description, with reference to the accompanying drawings wherein the preferred embodiment of the present invention is clearly shown.

In the drawings:

FIGS. 3(A) and 3(B) are drawings showing configurations of data representing a drum part to be played;

FIGS. 3(C) and 3(D) are drawings showing configurations of data representing a bass part to be played;

FIGS. 3(E) to 3(G) are drawings showing configurations of data representing a chord-backing part to be played;

FIG. 11 is a drawing showing an example of detailed contents of the table stored in the priority table memory.

DESCRIPTION OF THE PREFERRED EMBODIMENT

Figure 1:
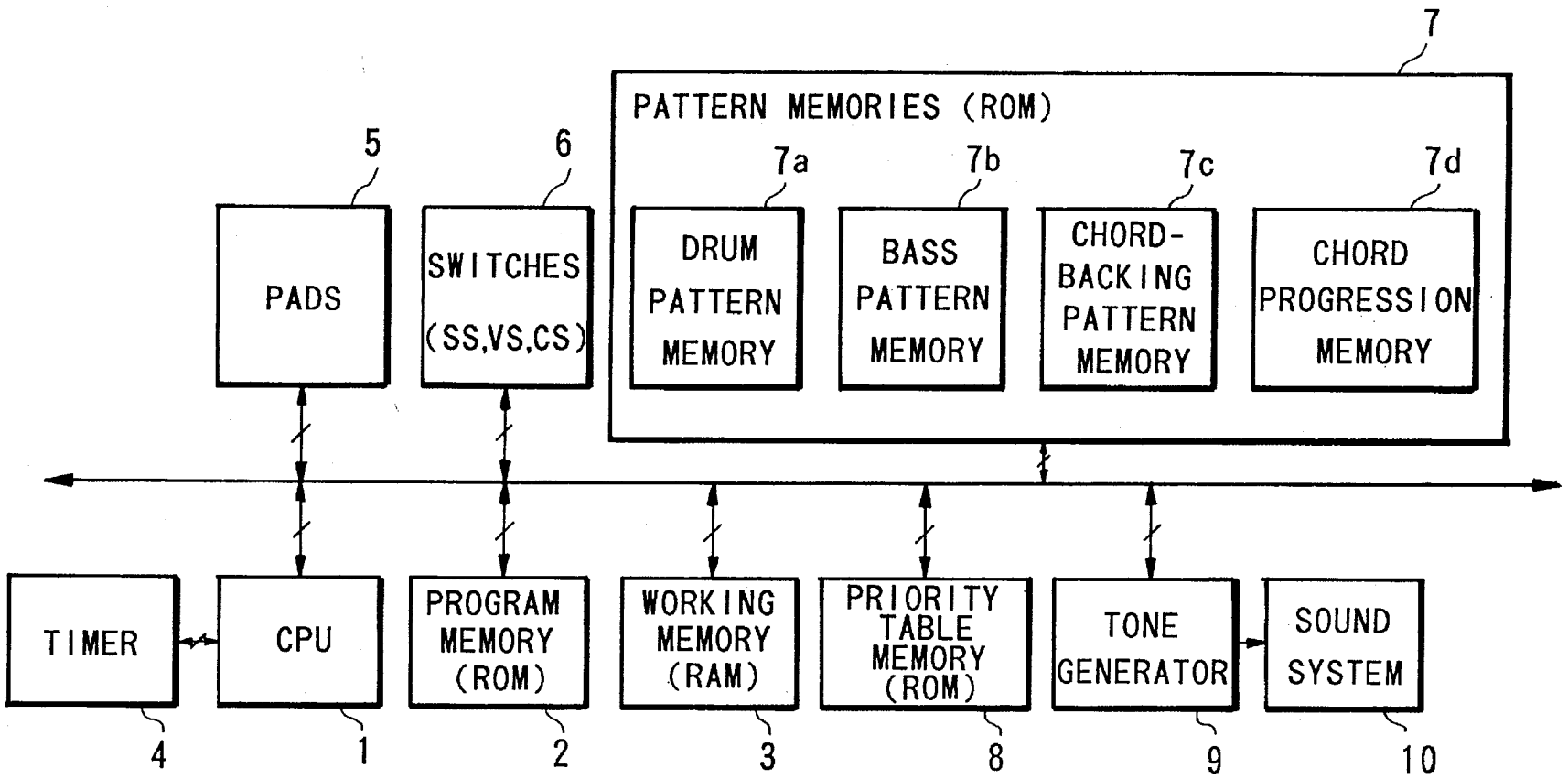
FIG. 1 is a block diagram showing an electronic musical instrument employing an automatic performance apparatus according to an embodiment of the present invention.

Now, the preferred embodiment of the present invention will be described in detail by referring to the drawings.

A. Whole Configuration

FIG. 1 is a block diagram showing a whole configuration of an electronic musical instrument employing an automatic performance apparatus according to an embodiment of the present invention. The electronic musical Instrument shown in FIG. 1 is designed to play an automatic performance other than the normal rhythm performance utilizing sounds of percussion instruments. In FIG. 1, a numeral 1 denotes a central processing unit (i.e., CPU) which controls several portions of the electronic musical instrument by executing programs. The detailed operations of the CPU 1 will be described later. A numeral 2 denotes a program memory, embodied by a read-only memory (i.e., ROM), which stores several kinds of control programs to be executed by the CPU 1. A numeral 3 denotes a working memory, embodied by a random-access memory (i.e., RAM), which is provided as a work area for the CPU 1. Results of several kinds of operations and values of registers are temporarily stored in the working memory 3. A numeral 4 denotes a timer which produces tempo clocks TMP regulating a performance tempo which is used when playing an automatic performance. Those tempo clocks TMP are supplied to the CPU 1. Every time the CPU 1 receives the tempo clock TMP from the timer 4, the CPU 1 executes a routine of an interrupt process, the contents of which will be described later.

Figure 2:
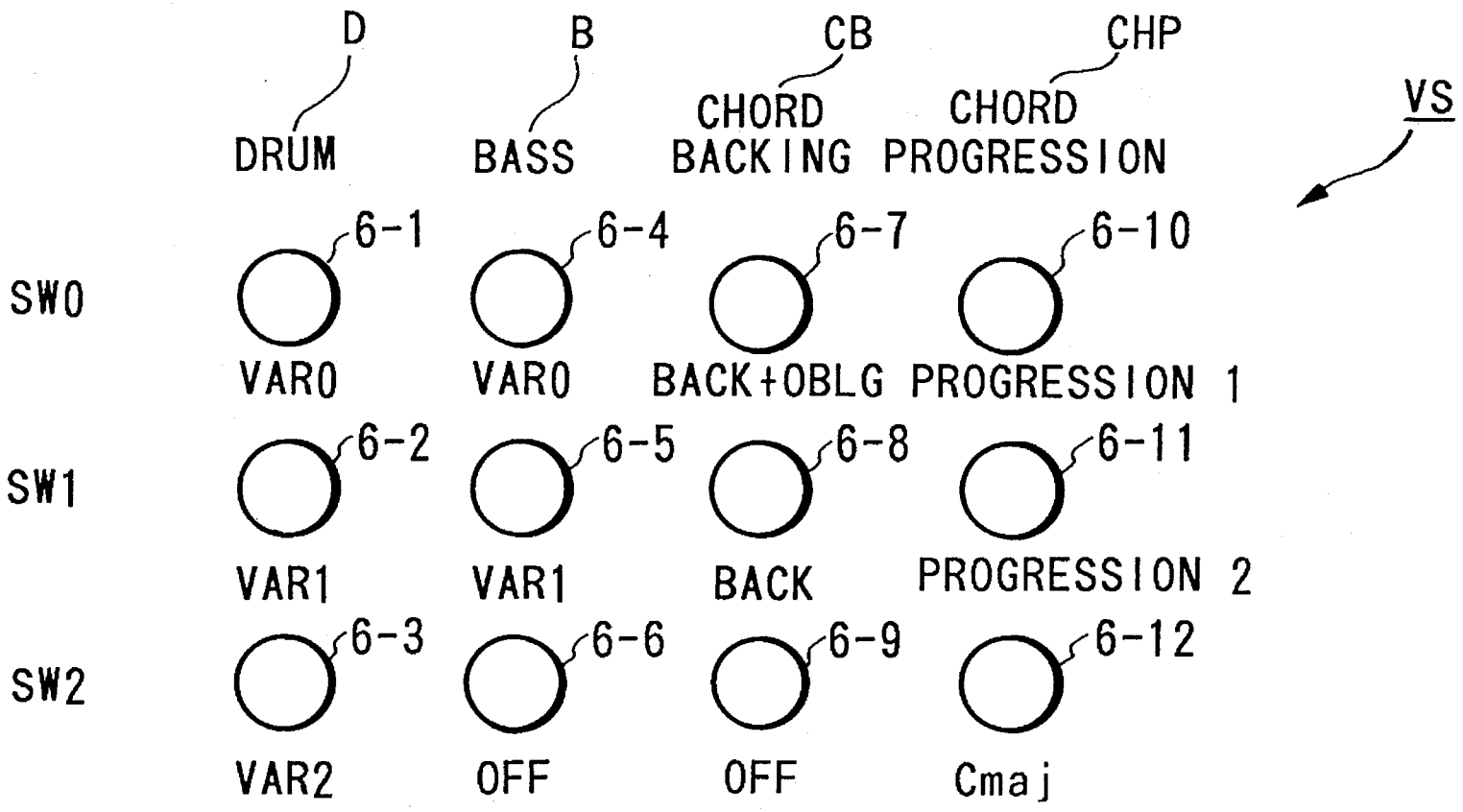
FIG. 2 shows an example of an arrangement of variation switches.

A numeral 5 denotes pads which are arranged on a front portion of a panel face (not shown) of tile electronic musical instrument. Those pads 5 are beaten by sticks when playing a rhythm performance. Each of the pads 5 provides a vibration sensor sensing a striking intensity when being beaten by the stick. When the striking intensity exceeds a predetermined level, the pad 5 produces a key-on signal. A numeral 6 denotes switches which are arranged along the front portion of the panel face. Each of those switches 6 produces a switching signal when being operated. The switches 6 include a start/stop switch SS, a style selection switch ST, a variation switch VS and a combination switch CS. The start/stop switch SS is provided to designate a start timing or a stop timing of the automatic performance. The style selection switch ST is provided to select a desired performance style used for the automatic performance. The variation switch VS is provided to select one of performing manners with respect to the same performance style as shown in FIG. 2. After the performance style is designated by operating the style selection switch ST, the combination switch CS is used to freely combine the performing manners (or accompaniment manners) for the automatic performance.

Next, the configuration of the variation switch VS (actually, a variation switch unit) will be described by referring to FIG. 2. The variation switch unit contains twelve switches 6-1 to 6-12 which are arranged in a three-by-four rectangular array. Herein, four functions described by "DRUM PART D", "BASS PART B", "CHORD BACKING PART CB" and "CHORD PROGRESSION CHP" are respectively assigned to the switches disposed in four columns of tile array, while three variation modes SW0, SW1 and SW2 are respectively assigned to the switches disposed in three rows of the array. Incidentally, the switches 6-10 to 6-12 to which "CHORD PROGRESSION CHP" is assigned can also be called chord progression switches.

By operating one of the switches 6-1 to 6-3, respectively corresponding to the variation modes SW0 to SW2 belonging to the drum part D, it is possible to select a corresponding one of the variations VAR0 to VAR2 for the drum performance pattern. By operating one of the switches 6-4 and 6-5, respectively corresponding to the variation modes SW0 and SW1 belonging to the bass part B, it is possible to select a corresponding one of the variations VAR1 and VAR2 for the bass performance pattern. Incidentally, the switch 6-6 corresponding to the variation mode SW2 is provided to stop the performance of the bass part B, thus terminating tone generation based on the bass performance pattern.

By use of the switches belonging to the chord-backing part CB, it is possible to select a desired accompaniment manner in response to one of the variation modes SW0 to SW2. More specifically, the switch 6-7 corresponding to the variation mode SW0 is capable of designating one of a backing part and an obbligato part. Herein, rhythmic chord accompaniment using the sounds belonging to the intermediate tone area is performed in the backing part, while melodic accompaniment using the sounds belonging to the intermediate tone area is performed in the obbligato part. The switch 6-8 corresponding to the variation mode SW1 is used to merely designate the backing performance. The switch 6-9 corresponding to the variation mode SW2 is provided to stop tone generation based on the chord backing pattern.

The switches belonging to the chord progression CHP are provided to select a desired chord progression pattern. More specifically, one of chord progression patterns "1" and "2" is selected in response to an operation of one of the switches 6-10 and 6-11. The chord progression patterns "1" and "2" include a major chord progression and a minor chord progression. When the switch 6-12 corresponding to the variation mode SW2 is operated, a chord of C major is fixedly used for a while, so that a chord progression is avoided.

Next, the configuration of the electronic musical instrument will be described again by referring to FIG. 1. A numeral 7 denotes pattern memories each of which is embodied by a ROM. The pattern memories 7, include a drum pattern memory 7*a*, a bass pattern memory 7*b*, a chord-backing pattern memory 7*c* and a chord-progression pattern memory 7*d*. One of patterns stored in the pattern memories 7*a* to 7*d* is selected upon the operation of the variation switch VS, so that the selected patterns are sequentially read out from the pattern memories. The detailed contents of the pattern memories 7*a* to 7*d* will be described later.

A numeral 8 denotes a priority table memory, embodied by a ROM, which stores chord-progression manners adequate to each performance style in advance. Using certain data produced from the priority table memory 8, one of the chord-progression manners (i.e., one of the major chord progressions and minor chord progressions) is designated in response to the performance style designated by the style selection switch ST. The detailed contents of the priority table memory 8 will be described later. A numeral 9 designates a tone generator (or a sound source) which is configured on the basis of a known waveform-memory-read-out system.

The tone generator 9 is designed to produce a predetermined rhythm-instrument sound In accordance with a key-on signal supplied from the CPU 1 when the rhythm performance is carried out by use of the pads 5. When playing the automatic performance, a musical tone signal representing a performance sound or an accompaniment sound is produced at a tone-generation timing which is determined in accordance with each of the patterns (i.e., drum pattern, bass pattern and chord-backing pattern), the data of which are read from the pattern memories 7a to 7d. In this case, the tone pitch of the musical tone signal produced is determined responsive to the chord progression. Next, a numeral 10 denotes a sound system which imparts a sound effect to the musical tone signal outputted from the tone generator 9, or which performs a filtering operation on the musical tone signal so as to remove unnecessary noise components. Then, the musical tone signal filtered is subjected to digital-to-analog conversion and amplification; thereafter, the corresponding musical tones are produced from speakers (not shown).

B. Configurations of Memories 7 and 8

① Configurations of pattern memories 7

Next, the configurations of the pattern memories 7 will be described by referring to FIGS. 3(A) to 4(B). A set of pattern memories 7a to 7d is provided for each of tile performance styles. In other words, the whole storage configuration of the ROM containing the pattern memories has a hierarchical structure containing plural sets of pattern memories 7a–7d, and each set of is selected by the aforementioned style selection switch ST and the variation switch VS. Thus, a certain set of pattern memories 7a–7d is provided in response to the performance style designated by the style selection switch ST; and then, the contents of those pattern memories 7a–7d are selected by the variation switch VS. Actually, the storage area of one ROM is divided into several sectors which are used as the pattern memories. However, for convenience, there are provided a plurality of memories as the pattern memories. In response to the operation of the variation switch VS, the contents of the pattern memories 7a–7d to be read out are selected. Next, a detailed configuration of each pattern memory will be described in detail.

(a) Drum Pattern Memory 7a

The drum pattern memory 7a is provided to store the performance styles of percussion instruments. As shown in FIG. 3(A), the storage area of the drum pattern memory 7a is divided into three sectors that store data of variations VAR0 to VAR2 respectively. Each data variation has different contents for the musical performance. Each data of the variations VAR0 to VAR2 is made by two kinds of data representing a timing TM and a percussion-instrument number DN respectively as shown in FIG. 3(B). The timing TM represents the tone-generation timing. Each drum performance pattern is eventually stored in the drum pattern memory 7a with a certain resolution, according to which the minimum unit to be set for the drum performance pattern is made identical to a time length of ninety-six notes. In response to a value of a pointer DP whose value is changed step by step, each data is designated and is read out. Thus, the data is sequentially or repeatedly read out. Incidentally, the percussion-instrument number DN is information representing the tone color of the percussion instrument such as a snare drum and bass drum.

(b) Bass Pattern Memory 7b

The bass pattern memory 7b is provided to store the performance patterns mainly using the tone color produced from the musical instrument having a lower tone area such as a bass guitar and tuba. As shown in FIG. 3(C), the storage area of the bass pattern memory 7b is divided into two sectors which respectively store data variations VAR0 and VAR1, each having different contents. As shown in FIG. 3(D), the data representing the tone-generation timing TM and data representing a keycode KC are alternatively stored as the variations VAR0 and VAR1. The data will form the bass performance pattern. Like the aforementioned drum performance pattern, the bass performance pattern is eventually stored in the bass pattern memory 7b with a certain resolution corresponding to the time length of ninety-six notes. The above-mentioned data is sequentially or repeatedly read out in response to a value of a pointer BP whose value is changed step by step.

(c) Chord-Backing Pattern Memory 7c

The chord-backing pattern memory 7c consists of two areas which store a backing pattern BACK and a obbligato pattern OBLG respectively as shown in FIG. 3(E). Herein, the backing pattern BACK represents a rhythmic chord accompaniment that mainly uses the tone color, corresponding to the intermediate tone area, produced by a piano, guitar strings and the like, while the obbligato pattern OBLG represents the melodic accompaniment. As shown in FIG. 3(F), the data representing the timing TM and keycode KC are alternatively stored as the backing pattern BACK. As shown in FIG. 3(G), the data representing the timing TM and keycode KC are alternatively stored as the obbligato pattern OBLG. Each of the backing pattern BACK and obbligato pattern OBLG is stored with a certain resolution corresponding to the time length of ninety-six notes. Hence, each data is read out from the backing pattern BACK in response to a value of a pointer CP, while each data is read out from the obbligato pattern OBLG in response to a value of a pointer OP.

(d) Chord-Progression Pattern Memory 7d

Figures 4A, 4B, 5:
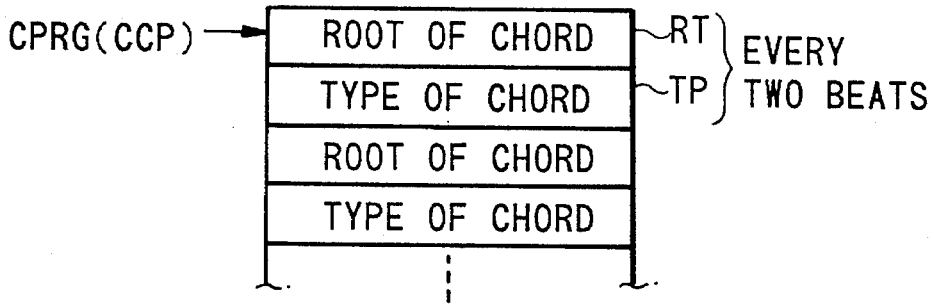
FIGS. 4(A) and 4(B) are drawings showing configurations of data representing a chord-progression pattern.
FIG. 5 is a drawing showing conceptual contents of a table stored in a priority table memory.

As shown in FIG. 4(A), the storage area of the chord-progression pattern memory 7d is divided into two sectors which respectively store a major chord-progression pattern MAJ and a minor chord-progression pattern MIN. Herein, the major chord-progression pattern MAJ represents the chord progression pattern in the major key, while the minor chord-progression pattern MIN represents the chord progression pattern in the minor key. Each of the major chord-progression pattern MAJ and minor chord-progression pattern MIN is formed by at least a pair of a root of chord "RT" and a type of chord "TYP" as shown in FIG. 4(B). The chord data which designates chords to be generated in eight measures are stored by every two beats corresponding to a half-note. The data is sequentially or repeatedly read out in response to a value of a pointer CCP whose value is changed step by step. Thus, the chord pattern corresponding to eight measures is repeated in the present embodiment. Incidentally, the present embodiment can be re-designed such that a long chord pattern corresponding to all of the measures contained in one tune can be recorded and then reproduced.

② Priority Table Memory 8

Next, the configuration of the priority table memory 8 will be described by referring to FIG. 5. FIG. 5 is a conceptual drawing which shows the stored contents of the priority table memory 8. In FIG. 5, a symbol "STYL" represents a style number which is designated by the aforementioned style selection switch ST. For example, when "dance" is designated by operating the style selection switch ST, a style number STYL is set at "0". Each of the items to be designated by the style selection switch ST is related to each of the style numbers STYL in advance. A symbol "ORD" is chord-progression designating data representing a chord progression manner for the performance style designated by the style number STYL. In other words, the chord-progression designating data ORD represents one of the major chord progression and minor chord progression. The major chord progression is represented by a value "0", while the minor chord progression is represented by a value "1". The values "0" and "1" are used in the programs corresponding to the flowcharts, the contents of which will be described later.

The chord-progression designating data ORD consists of two elements ORD(0) and ORD(1). Herein, the element ORD(0) is used to indicate that chord progression manner designated by the chord-progression designating data ORD the is the most musically suitable for the performance style designated by the style number STYL. In other words, the element ORD(0) is used to indicate that the chord progression manner designated by the chord-progression designating data ORD is given the highest priority in that performance style. When the chord progression pattern "1" is selected by designating the variation mode SW0 (see FIG. 2), in other words, when the switch 6-10 is operated, the element ORD(0) is read from the priority table memory 8.

Another element ORD(1) is provided to represent the chord progression manner which is provided as an option to be selected. When the aforementioned chord progression pattern "2" is selected by designating the variation mode SW1, in other words when the switch 6-11 is operated, the element ORD(1) is read from the priority table memory 8. For example, when "dance" is selected by the style selection switch and the variation mode SW0 is selected, the element ORD(0) representing the minor chord progression is outputted from the priority table memory 8. Thus, the minor chord-progression pattern MIN (see FIG. 4(A)) is read from the chord-progression pattern memory 7*d* when playing the automatic performance. On the other hand, when the variation mode SW1 is selected, the element ORD(1) representing the major chord progression is outputted from the priority table memory 8. As a result, the major chord-progression pattern MAJ (see FIG. 4(A)) is read from tile chord-progression pattern memory 7*d*. FIG. 11 shows tile relationship between the performance style and chord progression pattern. In FIG. 11, each of numbers "1" to "8" respectively described in columns of the table is a number of measure.

C. Operations of Embodiment

Next, the operations of the automatic performance apparatus having the configuration as described heretofore will be described in detail by referring to the flowcharts shown in FIGS. 6 to 10. In the description, operations corresponding to each of events will be described first (see ①–⑥); and then, a routine of interrupt process and a routine of reproduction process, both of which are required for performing the operations of the automatic performance apparatus, will be described (see ⑦–⑧); and lastly, operations of the automatic performance apparatus responding to each of the events will be described (see ⑨).

① Pad-on event

Figure 6:
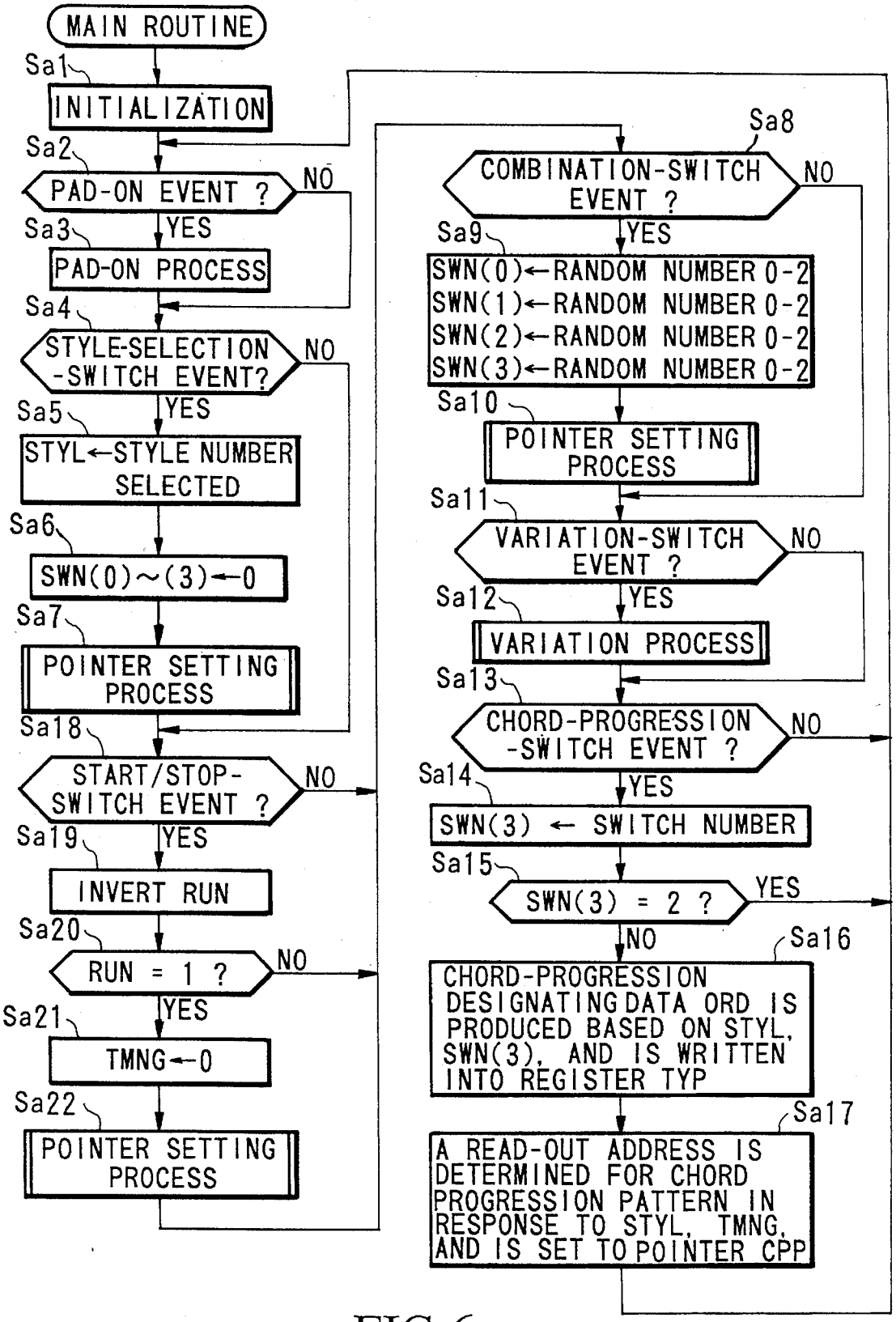
FIG. 6 is a flowchart showing a main routine to be executed by a CPU.

When the power is applied to the electronic musical instrument shown in FIG. 1, the CPU 1 reads out the control programs stored in the program memory 2. Thus, a main routine as shown in FIG. 6 is started, so that the processing of the CPU 1 proceeds to step Sa1. In step Sa1, an initialization process is carried out so as to reset values of the registers. In next step Sa2, the CPU 1 judges whether or not a pad-on event has occurred. When the aforementioned pad 5 is beaten by the stick, the vibration sensor equipped within the pad 5 is activated to sense a vibration corresponding to a striking intensity applied to the pad 5. When the level of the vibration applied to the pad 5 exceeds a predetermined level, a pad-on event is detected.

When the pad-on event is detected, a result of the judgement performed by the CPU 1 in step Sa2 is described by an affirmative term "YES", so that the processing of the CPU 1 proceeds to step Sa3. In step Sa3, a pad-on process is carried out. According to the pad-on process, the key-on signal which is produced responsive to the pad-on event Is supplied to the tone generator 9, so that the tone generator 9 forms a percussion-instrument sound which is determined in advance. Thus, the predetermined percussion-instrument sounds are produced in accordance with striking intensities applied to the pads 5, so that the rhythm performance will be eventually played by the performer.

② Style-Selection-Switch Event

If the above-mentioned pad-on event is not occurred so that the result of the judgement in step Sa2 is described by a negative term "NO", or when the pad-on process in step Sa3 is completely performed, the processing of the CPU 1 proceeds to step Sa4. Then, if the style selection switch ST is operated, a style-selection-switch event has occurred, so that a result of the judgement in step Sa4 turns to "YES". Thus, the processing proceeds to step Sa5 in which a performance style number corresponding to the style selection switch ST operated is set into a register STYL.

In next step Sa6, the same value "0" is set onto all of the registers SWN(0) to SWN(3). The registers SWN(0) to SWN(3) are provided to temporarily store the setting conditions of the variation switches VS. Therefore, when the value "0" is set into the registers SWN(0) to SWN(3), the variation mode SW0 is selected; in other words, tile aforementioned switches 6-1, 6-4, 6-7 and 6-10 (see FIG. 2) are selected. In short, after the style selection switch ST is operated, the drum part is performed by the variation VAR0; the bass part is performed by the variation VAR0; the chord-backing part is performed by "BACK+OBLG" (which represents the backing pattern BACK together with the obbligato pattern OBLG); and the chord progression is performed by the chord progression pattern "0". In particularly, the chord progression pattern corresponding to the maximum priority level which is designated by the data ORD is selected for the chord progression to be currently performed.

By performing the above-mentioned processes of steps Sa1 to Sa6, initial conditions are set for the electronic musical instrument. Then, the processing of the CPU 1 proceeds to step Sa7 in which a routine of pointer setting process (see FIG. 7) is started. In the routine of pointer setting process, predetermined values are respectively set to the pointer DP for the drum part D, the pointer BP for the bass part B, the pointers CP and 0P for the chord-backing part CB and the pointer CPP for the chord progression CHP. Next, the operations used to set the values of the pointers will be described by referring to FIG. 7.

(a) Pointer DP

Figure 7:
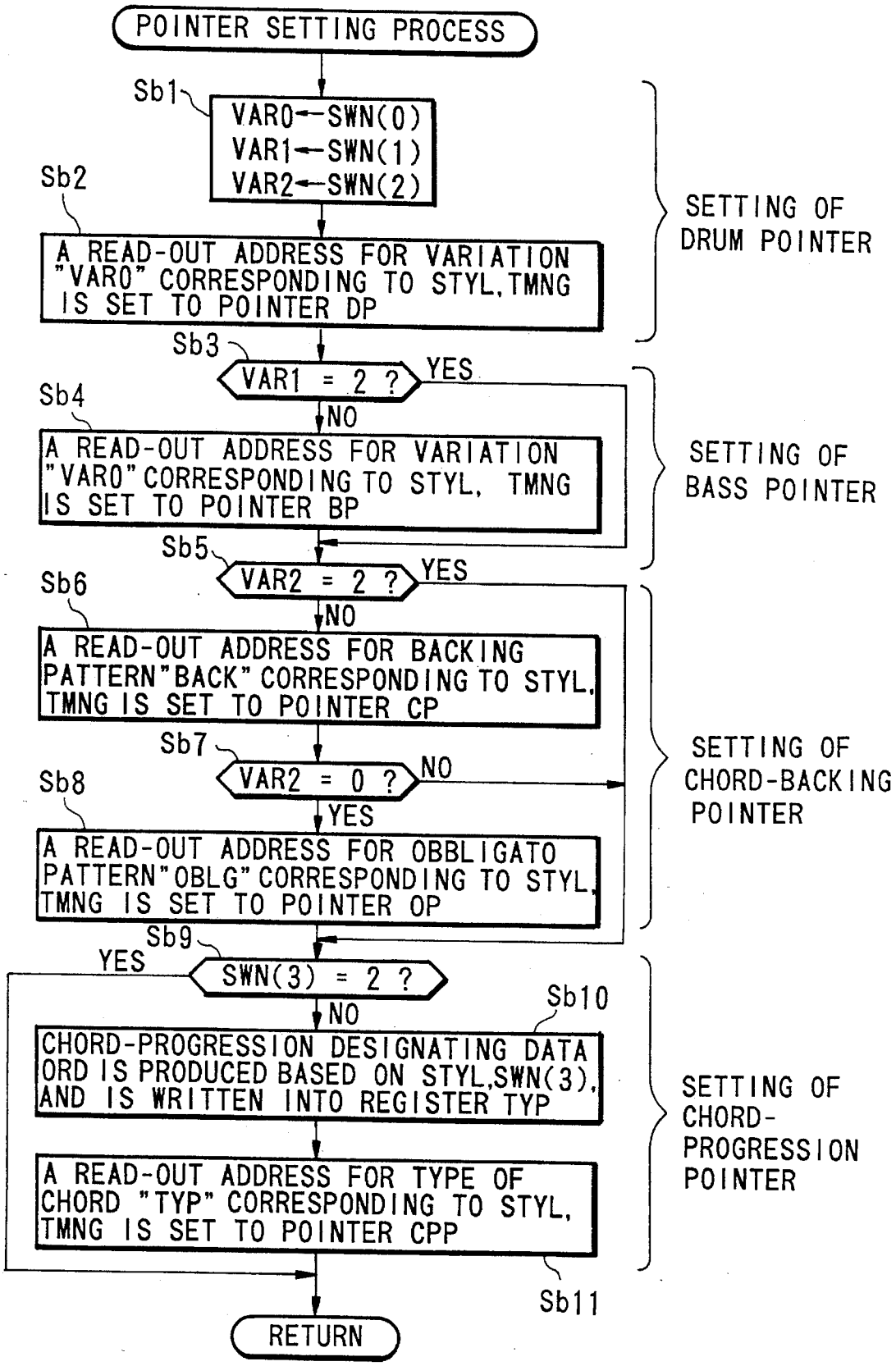
FIG. 7 is a flowchart showing a routine of pointer setting process.
Figure 8:
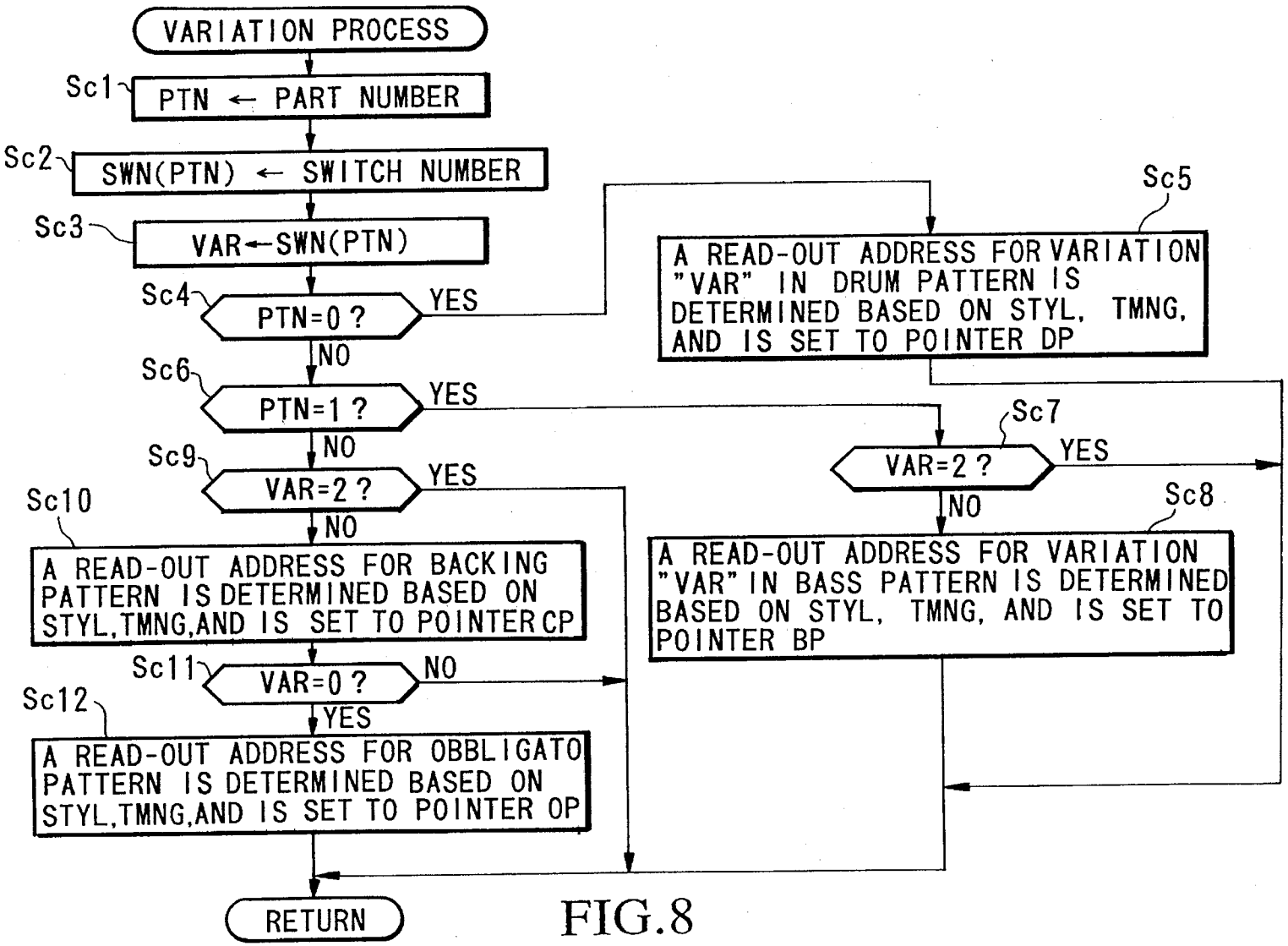
FIG. 8 is a flowchart showing a routine of variation process.

When the routine of pointer setting process is started, the processing of the CPU 1 proceeds to step Sb1 shown in FIG. 7. In step Sb1, the values of tile aforementioned registers SWN(0), SWN(1) and SWN(2) are read out and then respectively set to the registers VAR0, VAR1 and VAR2. In this case, the value "0" is set to all of the registers VAR0, VAR1 and VAR2. In step Sb2, a read-out address for the variation VAR0 provided in the drum part D stored in the drum pattern memory 7*a* (see FIG. 3(A)) is created in accordance with the contents of the register STYL and contents of a register TMNG; and then, the read-out address is set to the pointer register DP.

The above-mentioned drum pattern memory 7*a* is the drum pattern memory which is provided responsive to the performance style designated by the contents of the register STYL. Hence, the read-out address for the variation VAR0 stored in the drum pattern memory 7*a* (see FIG. 3(A)) is determined in response to the contents of the register TMNG. Incidentally, a count value representing the number of the tempo clocks TMP counted is set to tile register TMNG.

(b) Pointer BP

After completing a setting operation of the pointer DP, the processing of the CPU 1 proceeds to step Sb3. In step Sb3, it is judged whether or not the value of the register VAR1 is equal to "2". Since the value "0" has been already set to the register VAR1 by the process of step Sb1, a result of the judgement in step Sb3 turns to "NO" so that the processing proceeds to step Sb4. The process of step Sb4 is similar to the process of step Sb3. More specifically, in step Sb4, the bass pattern memory corresponding to the performance style designated by the contents of the register STYL is selected as the bass patter memory 7*b;* and then, a read-out address for the variation VAR0 stored in that bass pattern memory 7*b* (see FIG. 3(C)) is determined in response to the contents of tile register TMNG. Thereafter, the read-out address is set to the pointer register BP.

(c) Pointer CP

Next, when the processing of the CPU 1 proceeds to step Sb5, it is judged whether or not the value of the register VAR2 is equal to "2". Since the value "0" has been already set to the register VAR2 by the process of step Sb1, a result of the judgement in step Sb5 turns to "NO" so that the processing proceeds to step Sb6. Similar to the foregoing step Sb3, in step Sb6, the chord-backing pattern memory corresponding to the performance style designated by the contents of the register STYL is selected as the chord-backing pattern memory 7*c;* and then, a read-out address for the backing pattern BACK stored in that chord-backing pattern memory 7*c* (see FIG. 3(E)) is determined in response to the contents of the register TMNG. Thereafter, the read-out address is set to the pointer register CP.

(d) Pointer 0P

When the processing of the CPU 1 proceeds to step Sb7, it is judged whether or not the value of the register VAR2 is equal to "0". Since the value "0" has been already set to the register VAR2 by the process of step Sb1, a result of the judgement in step Sb7 turns to "YES" so that the processing proceeds to step Sb8. Similar to the foregoing step Sb3, in step Sb8 the chord-backing pattern memory corresponding to the performance style designated by the contents of the register STYL is selected as the chord-backing pattern memory 7*c;* and then, a read-out address for the obbligato pattern OBLG stored in that chord-backing pattern memory 7*c* (see FIG. 3(E)) is determined in response to the contents of the register TMNG. Thereafter, the read-out address is set to the pointer OP.

(e) Pointer CPP

When the processing of the CPU 1 proceeds to step Sb9, it is judged whether or not the value of the register SWN(3) is equal to "2". Since the value "0" has been already set to the register SWN(3) by the foregoing step Sa6 in the main routine (see FIG. 6), a result of the judgement in step Sb9 turns to "NO" so that the processing proceeds to step Sb10. In step Sb10, the CPU 1 refers to the priority table memory 8 so as to select the chord progression pattern corresponding to the designated performance style and the variation mode SW0 or SW1. In the current situation, the value of the register SWN(3) is set at "0", so that the variation mode SW0 is selected. For example, when the performance style designated by the register STYL is represented by "dance" (see FIG. 5), the priority table memory 8 produces the chord-progression designating data ORD which represents the minor chord progression. In this case, the chord-progression designating data ORD is set at "0". Hence, the CPU 1 writes the value "1" into the register TYP.

In step Sb11, the chord-progression pattern memory corresponding to the performance style designated by the register STYL is selected as the chord-progression pattern memory 7*d.* Hence, a read-out address for the chord progression pattern stored in the chord-progression pattern memory 7*d,* i.e., a read-out address for tile chord progression pattern designated by the register TYP, is determined in response to the contents of the register TMNG. Then, the read-out address is set to the pointer register CPP. If the minor chord-progression pattern MIN is designated, a read-out address for it is produced. After completing the setting operations for the pointers described heretofore, the processing of the CPU 1 returns back to the main routine shown in FIG. 6 again.

③ Combination-Switch Event

When the combination switch CS is operated, the aforementioned processing for the style-selection-switch event is completed, and then, the processing of the CPU 1 returns to the main routine. In this case, a switch-on event for the combination switch CS is detected in step Sa8. Thus, a result of the Judgement in step Sa8 turns to "YES", so that the processing of the CPU 1 proceeds to step Sa9 (see FIG. 6). As described before, after the style selection switch ST is operated to designate a certain performance style, the combination switch CS is operated in order to automatically combine the performance manners (or accompaniment manners) for the automatic performance.

In step Sa9, the CPU 1 produces random numbers by use of a randomizing function and the like. Thus, the random numbers are set into the registers SWN(0) to SWN(3). In the present embodiment, the random number is changed among "0", "2" and "3". By use of such random numbers, it is possible to simultaneously set the performance part (e.g., drum part, bass part and chord-backing part) and the chord-progression manner at random. In other words, it is possible to instantaneously make a unique combination of accompaniment patterns with respect to each performance part.

Next, the processing proceeds to step Sa10, in which the CPU 1 executes the aforementioned routine of pointer setting process (i.e., processes of steps Sb1 to Sb11 shown in FIG. 7) so as to set the read-out addresses to the pointers. If the random number "2" is set to the register SWN(1) by the aforementioned process of step Sa9, the result of the Judgement in step Sb3 turns to "YES" because the number "2" set in the register SWN(1) indicates a turn-off state for the bass part B. In such case, the read-out address is not produced for the pointer BP. On the other hand, when the random number "2" is set to the register SWN(2), the result of the Judgement in step Sb5 turns to "YES" because the number "2" set to the register SWN(2) indicates a turn-off state for the chord-backing part CB. In this case, the read-out addresses are not produced for the pointers CP and OP.

Furthermore, when the random number "0" is set to the register SWN(2), the result of the Judgement in step Sb7 turns to "NO" because the number "0" set to the register SWN(2) indicates that only the backing pattern BACK is used as the accompaniment pattern. In this case, the read-out address is not produced for the pointer OP. When the random number "2" is set to the register SWN(3), the result of the judgement in step Sb9 turns to "YES", so that the read-out address is not produced for the pointer CPP. In this case, a progression of chords is avoided, so that the chord to be currently produced is limited to the chord of C major. In tile present embodiment, each of the parts is made on the basis of the chord-progression pattern using the chord of C major. If another chord other than the chord of C major is designated, tone-pitch conversion may be required. However, since each part is made on the basis of the chord-progression pattern using the chord of C major in advance, it is possible to perform the music using the chord of C major without carrying out the tone-pitch conversion. As described above, it is possible to simultaneously determine the performance part and chord-progression pattern, so that the values of the pointers are correspondingly set. When completing the setting operations of the pointers, the processing of the CPU 1 returns to the main routine (see FIG. 6) again.

④ Variation-Switch Event

When processing of the CPU 1 returns back to the main routine so that its processes are occurring, when the variation switch VS is operated, a result of a judgement performed in step Sa11 turns to "YES" because a switch-on event of the variation switch VS is detected. Then, the processing proceeds to step Sa12, in which the CPU 1 activates a routine for the variation process. Thus, the processing of the CPU 1 proceeds to step Sc1. In the routine of variation process, desired values are set to the pointers DP, BP, CP and 0P in response to the operations of the variation switches VS.

When one of the variation switches VS (see FIG. 2) is operated, a certain part number is designated in response to the operated variation switch. In step Sc1, the part number designated is written into a register PTN. If one of the switches 6-1 to 6-3 belonging to the drum part D is operated, the part number is set at "0". If one of the switches 6-7 to 6-9 belonging to the chord-backing part CB is operated, the part number is set at "2".

In step Sc2, the value corresponding to the variation mode SW0–SW2 designated by the operated switch is set to a register SWN(PTN). The above-mentioned value corresponding to the variation mode SW0-SW2 is limited to the predetermined values "0", "1" and "2". For example, when the switch 6-1 corresponding to the variation VAR0 belonging to the drum part D is operated, the value "0" is selectively set to the register SWN(0). In step Sc3, the CPU 1 reads out the data stored in the register SWN(PTN); and then, the read data is written into the register VAR. Thereafter, the processing proceeds to step Sc4. Incidentally, the contents of the register VAR should be set in response to the variation mode SW0-SW2 designated by the switch operated.

In step Sc4, it is Judged whether or not the value of the register PTN Is set at "0"; in other words, it is judged whether or not the switch concerned with the drum part is operated. If the switch concerned with the drum part is operated, a result of the Judgement in step Sc4 turns to "YES" so that the processing branches to step Sc5. In step Sc5, a read-out address is produced for the variation VAR0–VAR2 (see FIG. 3(A)) corresponding to the value of the register VAR in connection with the drum part D stored in the drum pattern memory 7*a* on the basis of the contents of the registers STYL and TMNG. Thereafter, the processing of the CPU 1 returns to the main routine.

If the result of the judgement in step Sc4 is described as "NO", the processing proceeds to step Sc6. In step Sc6, it is judged whether or not the value of the register PTN is set at "1"; in other words, it is judged whether or not the switch concerned with the bass part is operated. If the switch concerned with the bass part is operated, the result of the judgement in step Sc6 turns to "YES" so that the processing branches to step Sc7. In step Sc7, it is judged whether or not the value of the register VAR is set at "2"; in other words, it is judged whether or not the switching operation is made to turn off the performance of the bass part. If so, a result of the judgement in step Sc7 turns to "YES", so that the processing of the routine of variation process is terminated. In such case, the read-out address used for the bass part B is not produced for the pointer BP.

On the other hand, when the value of the register VAR is not equal to "2", one of the variations VAR0 and VAR1 can be selected. In this case, the result of the Judgement in step Sc7 turns to "NO", so that the processing proceeds to step Sc8. The process of step Sc8 is similar to that of step Sc5. More specifically, when the processing of the CPU 1 proceeds to step Sc8, the bass pattern memory corresponding to the performance style designated by the contents of the register STYL is selected as the bass pattern memory 7*b* to be currently used. On the basis of the contents of the register TMNG, a read-out address is determined with respect to the variation VAR0 (or VAR1) corresponding to the contents of tile register VAR. Then, the read-out address determined is set to the pointer register BP.

Meanwhile, if the switching operation is not concerned with the bass part, the result of the judgement performed in the aforementioned step Sc6 turns to "NO", so that the processing of the CPU i jumps to step Sc9. In such case, the switching operation for the variation switch VS does not concern the drum part and bass part; the switching operation currently made is assumed as the switching operation concerned with the chord-backing part. In step Sc9, it is judged whether or not the value of the register VAR is equal to "2"; in other words, it is judged whether or not the value of the register VAR indicates the turn-off state for the chord-backing part. If the value of the register VAR is equal to "2" (which corresponds to a switch-on event of the switch 6-9 shown in FIG. 2), a result of the judgement in step Sc9 turns to "YES", so that the processing of the routine of variation process is terminated. In this case, the read-out addresses are not produced for the pointers CP and OP concerned with the chord-backing part CB.

Meanwhile, when the value of the register VAR is not equal to "2", the result of the judgement in step Sc9 turns to "NO", so that the processing proceeds to step Sc10. In step Sc10, the backing pattern BACK is selected in response to the performance style designated by the contents of the register STYL; and then, a certain read-out address is determined in response to the contents of the register TMNG. This read-out address is set to the pointer register CP. Next, the processing of the CPU 1 proceeds to step Sc11. In step Sc11, it is judged whether or not the value of the register VAR is equal to "0".

If the value of the register VAR is not equal to "0", a result of the judgement in step Sc11 turns to "NO", so that the processing of the routine of variation process is terminated. In the case where the result of the judgement in step Sell is "NO", the switching operation should be made to select the backing pattern BACK. In this case, the read-out address is not produced for the pointer OP provided for the obbligato pattern OBLG.

Next, when the result of the judgement in step Sc11 turns to "YES", in other words, when the switch 6-7 shown in FIG. 2 is operated, the processing proceeds to step Sc12. In step Sc12, the obbligato pattern OBLG is selected in response to the performance style which is designated by the contents of the register STYL; and then, a certain read-out address is determined in response to the contents of the register TMNG. This read-out address is set to the pointer register 0P. As described above, when the switch 6-7 belonging to the variation switches VS is operated, the CPU 1 functions to produce the read-out addresses for the pointers CP and 0P which are respectively provided for the backing pattern BACK and obbligato pattern OBLG. Thus, the processing of the routine of variation process is completed. Thereafter, the processing of the CPU 1 returns back to the main routine, shown in FIG. 6, again.

⑤ Chord-Progression-Switch Event

When the processing of the CPU 1 returns to the main routine so that its processes are sequentially carried out, and one of the chord-progression switches 6-10 to 6-12 (see FIG. 2) provided within the variation switches VS is operated, a judging process of step Sa13 provided in the main routine (see FIG. 6) is activated. In this case, a result of the judgement in step Sa13 turns to "YES" because the certain chord-progression switch is operated. Thus, the processing proceeds to step Sa14. In step Sa14, the switch number assigned to the chord-progression switch operated is set to the register SWN(3). Then, the processing proceeds to step Sa15. Incidentally, the switches 6-10 to 6-12 are respectively assigned the switch numbers "0", "1" and "2".

In step Sa15, it is judged whether or not the value of the register SWN(3) is equal to "2"; in other words, it is judged whether or not the switch 6-12 is operated. Herein, when the switch 6-12 is operated, a progression of the chords to be currently produced is stopped, so that the chord of C major is continuously produced. If the switch 6-12 is operated, a result of the judgement in step Sa15 turns to "YES". Thus, the processing for the chord-progression-switch event is completed. Thereafter, the musical performance is played only with the chord of C major without carrying out the tone-pitch conversion. On the other hand, when the switch 6-12 is not operated, in other words when one of the switches 6-10 and 6-11 which are respectively provided for selecting the chord progression pattern "1" and "2" is operated, the result of the judgement in step Sa15 turns to "NO"; and consequently, the processing proceeds to step Sa16.

In step Sa16, the CPU 1 refers to the priority table memory 8 so as to select the chord-progression pattern in response to the designated performance style and the switch number corresponding to the operated switch. For example, when the switch 6-10 selecting the chord progression pattern "1" (i.e., the switch corresponding to the variation mode SW0) is operated, the value of the register SWN(3) is set at "0". In this case, if the performance style indicated by the value of the register STYL represents "dance" (see FIG. 5), the certain chord-progression designating data ORD designating the minor chord progression is produced and is written into the register TYP.

In step Sa17, the chord-progression pattern memory corresponding to the performance style designated by the contents of the register STYL is selected as the chord-progression pattern memory 7*d* to be currently used. Further, a certain read-out address is determined for the chord progression pattern stored in the chord-progression pattern memory 7*d* (i.e., chord progression pattern designated by the contents of the register TYP) on the basis of the contents of the register TMNG. This read-out address is set to the pointer register CPP. As described above, in the chord-progression-switch event, it is possible to select one of the major chord progression and minor chord progression, which is fitted with the performance style currently designated, in response to the operation of the chord-progression switch 6-10 or 6-11. Furthermore, when the switch 6-12 is operated, the chord-progression pattern is changed to that using the chord of C major.

⑥ Start/Stop-Switch Event

When the user operates the start/stop switch SS which designates a start timing or a stop timing for the automatic performance while the CPU executes tile main routine, a judging process of step Sa18 (see FIG. 6) is activated to judge that the start/stop switch SS is operated. In that case, a result of the judgement in step Sa18 turns to "YES", so that the processing proceeds to step Sa19. In step Sa19, the CPU 1 inverts a binary numeral of a bit in a flag to be set to a register RUN. Then, the processing of the CPU 1 proceeds to step Sa20. Herein, the flag to be written into the register RUN has one of two digits "0" and "1". The digit "1" used for the flag indicates an event in which the automatic performance is now proceeding, while the digit "0" indicates that the automatic performance is stopped.

In step Sa20, it is judged whether or not the flag set in the register RUN is equal to "0". If the flag has the digit "0", a result of the judgement in step Sa20 turns to "NO". If so, the processing of the CPU 1 branches to the foregoing step Sa8 so that the CPU 1 detects an existence of the combination-switch event (which has been already described in paragraph ③). On the other hand, when the flag has the digit "1", the result of the judgement in step Sa20 turns to "YES", so that the processing of the CPU 1 proceeds to step Sa21. In step Sa21, in order to detect the performance tempo (or, in order to count the number of the tempo clocks), the register TMNG is reset to zero.

In step Sa22, the aforementioned routine of pointer setting process (which has been already described in paragraph ②) is executed, so that the read-out addresses are automatically set for the pointers concerned with the drum part, bass part, chord-backing part and the like. In the case where tile aforementioned processes (see steps Sa4 to Sa7) concerned with the style-selection-switch event (which has been already described in paragraph ②) are carried out prior to the automatic performance, the aforementioned pointers DP, BP, CB, CP, OP, CHP and CPP are respectively set in accordance with the selected performance style. As described before, the pointer DP concerns with the drum part D; the pointer BP concerns with the bass part B; the pointers CP and OP concerns with the chord-backing part CB; and the pointer CPP concerns with the chord progression pattern CHP.

⑦ Routine of Interrupt Process

Figure 9:
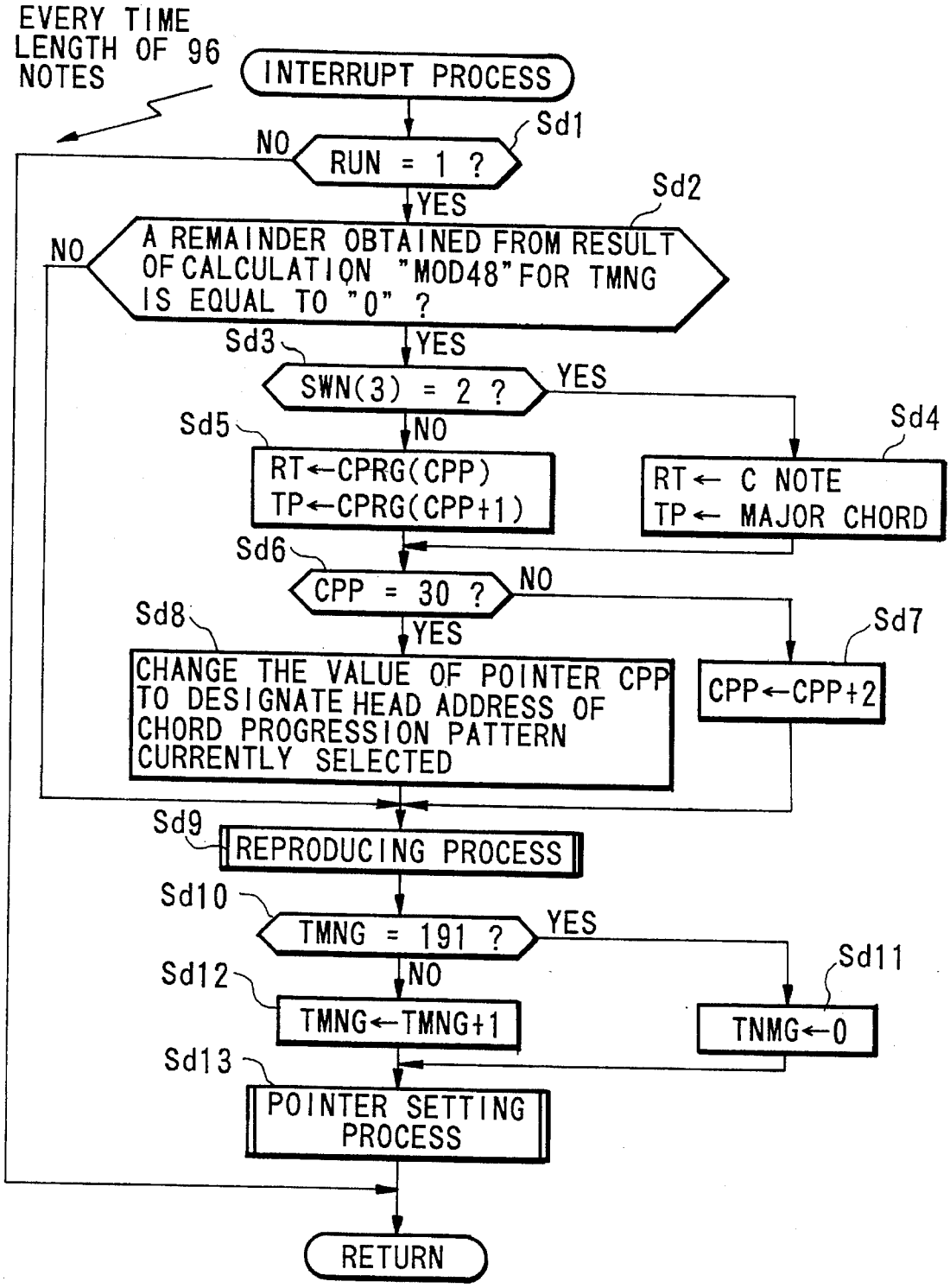
FIG. 9 is a flowchart showing a routine of interrupt process.

Next, the routine of interrupt process will be described in detail. According to the routine of interrupt process, each of the drum part, bass part and chord-backing part is reproduced in response to the tempo clocks TMP given from the timer 4. Every time length corresponding to ninety-six notes, the CPU 1 starts the routine of interrupt process as shown in FIG. 9 in response to the tempo clocks TMP. In first step Sd1, it is judged whether or not the flag written In the register RUN is set at "1", in other words, it is judged whether or not the apparatus is ready to start the automatic performance. If the flag is set at "0", a result of the judgement in step Sd1 turns to "NO", so that the processing of the CPU 1 directly returns back to the main routine without substantially executing any processes in the routine.

On the other hand, when the flag is set at "1", the result of the judgement in step Sd1 turns to "YES", so that the processing proceeds to step Sd2. Then, the CPU 1 reads out the value of the register TMNG, wherein the count value representing the number of the tempo clocks TMP is written in the register TMNG. This value is divided by forty-eight to obtain a remainder. Such calculation, used to obtain a remainder with respect to the dividend to be divided by forty-eight is represented by an expression "mod48". In step Sd2, the CPU 1 performs the calculation represented by the expression "mod48"; and then, it is judged whether or not the remainder is equal to "0". In other words, it is judged whether or not the performance timing corresponds to a first-beat timing or a third-beat timing. The performance timing corresponding to each of those timings is used as the timing to read out the chord progression pattern CHP. If so, a result of the judgement in step Sd2 turns to "YES", so that the processing proceeds to step Sd3. If not, in other words, if the performance timing corresponds to a second-beat timing, a result of the judgement in step Sd2 turns to "NO", so that the processing jumps to step Sd9.

In step Sd3, it is judged whether or not the value of the register SWN(3) is equal to "2"; in other words, it is judged whether or not the switch 6-12 is operated to declare that the chord progression is limited to that using the chord of C major. When the switch 6-12 is operated, a result of the judgement in step Sd3 turns to "YES", so that the processing branches to step Sd4. In step Sd4, data representing a C note is set to a register RT, while data representing the major chord is set to a register TP. Incidentally, the register RT is provided to store data representing the root of a chord, while the register TP is provided to store data representing the type of chord.

If the chord progression switch 6-10 or 6-11 other than the above-mentioned switch 6-12 is operated, the result of the judgement in step Sd3 turns to "NO", so that the processing of the CPU 1 proceeds to step Sd5. In step Sd5, the root of a chord designated by the value of the pointer CPP is set to the register RT with respect to the chord progression pattern which is selected in response to the operation of the chord progression switch 6-10 or 6-11. Further, the value of the pointer CPP is incremented to read out the type of chord; and then, the read type of chord is set to the register TP.

In step Sd6, it is judged whether or not the value of the pointer CPP whose value has been incremented becomes equal to "30". In other words, it is judged whether or not the reading operation is completely performed for the data corresponding to eight measures. If the reading operation for the data corresponding to eight measures has not been completed yet, a result of the judgement in step Sd6 turns to "NO", so that the processing branches to step Sd7. In step Sd7, in order to read out the next root of chord which is contained in the chord progression pattern, the value of the pointer CPP is increased by two. On the other hand, when the reading operation for the data of eight measures is completed, the processing proceeds to step Sd8 through step Sd6. In step Sd8, the value of the pointer is changed so as to designate the head address of the data representing the chord progression pattern which is currently selected.

As described above, when the chord progression pattern CHP is completely read out and tile pointer CPP is newly set, the processing of the CPU 1 proceeds to step Sd9, in which the CPU 1 executes a routine of reproducing process in accordance with the chord progression which is determined with respect to each of the drum part, bass part and chord-backing part. The details of the routine of reproducing process will be described later. After completing the reproducing process with respect to each of the parts, the processing of the CPU 1 proceeds to step Sd10. In step Sd10, it is judged whether or not the value of the register TMNG is equal to "191". Herein, the value of the register TMNG represents the count value which is increased after performing the reproducing process, while the value "191" corresponds to the count value when the reproduction for two measures is ended.

If the count value currently obtained corresponds to an end timing of the reproduction for two measures, a result of the judgement in step Sd10 turns to "YES", so that the processing branches to step Sd11. In step Sd11, the value of the register TMNG is cleared to zero. If the count value currently obtained indicates that the reproduction is now proceeding in the middle of two measures, the result of the judgement in step Sd10 turns to "NO", so that the processing proceeds to step Sd12. In step Sd12, the value of the register TMNG is Incremented by one so as to increment the count value. Thereafter, the processing proceeds to step Sd13, in which the CPU 1 executes the aforementioned routine of pointer setting process, the detailed contents of which has been already described in paragraph ②. Thus, the pointer is newly set with respect to each of the drum part, bass part and chord-backing part.

⑧ Routine of Reproducing Process

Figure 10:
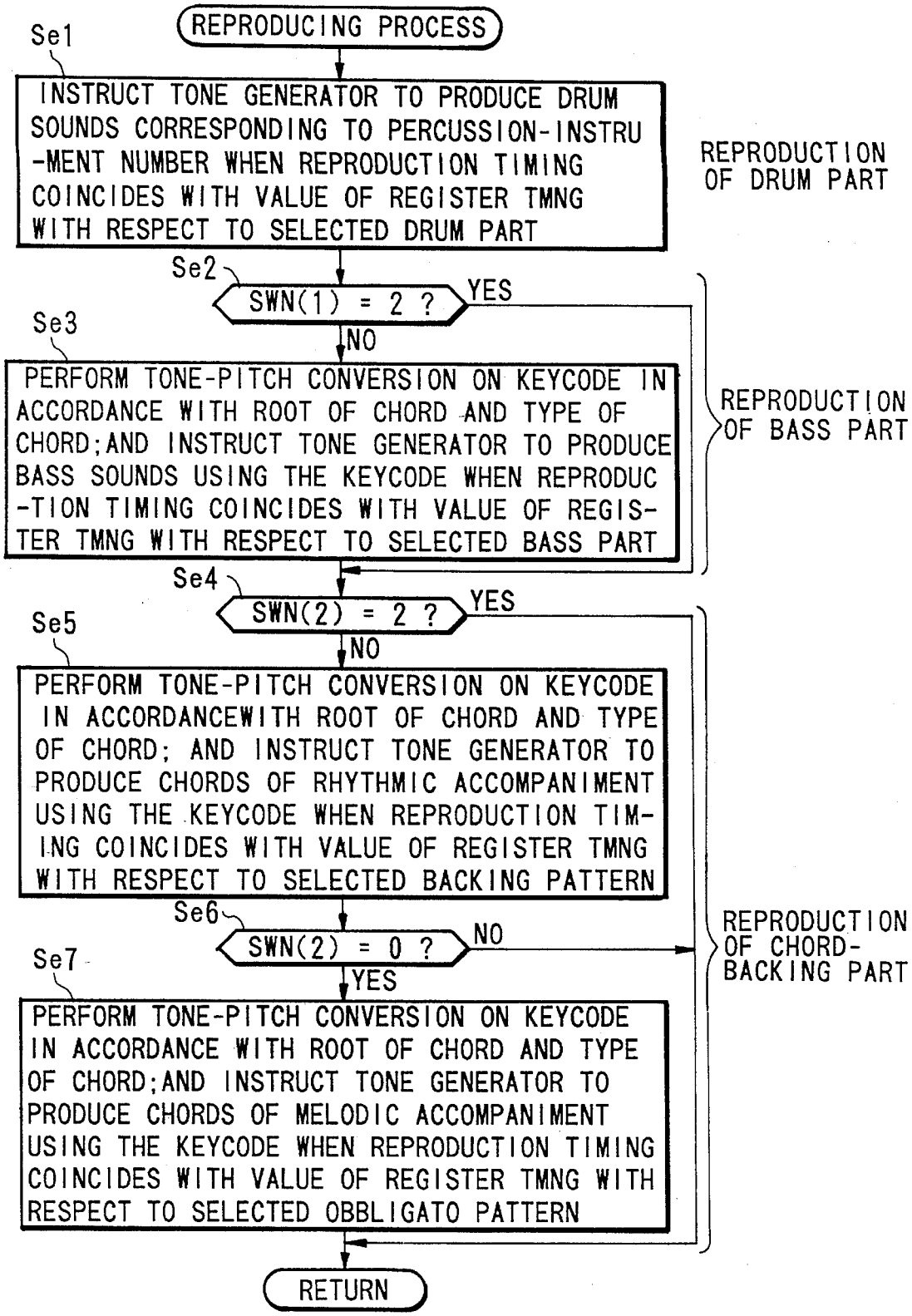
FIG. 10 is a flowchart showing a routine of reproducing process.

Next, the routine of reproducing process, which is called while executing the routine of interrupt process, will be described by referring to FIG. 10.

(a) Reproduction of drum part D

When the chord progression pattern CHP is read out and the pointer CPP is newly set up, the processing of the CPU 1 proceeds to step Sd9 so as to start the execution for the routine of reproducing process. At first, the processing proceeds to step Se1 shown in FIG. 10. In step Se1, the data concerned with the drum part D (i.e., the aforementioned timing TM and percussion-instrument number DN, see FIG. 3(B)) are read out in accordance with the values of the pointer DP. When the value of the timing TM coincides with the value of the register TMNG, the CPU 1 instructs the tone generator 9 to produce the drum sound corresponding to the percussion-instrument number DN. Thus, the tone generator 9 reproduces the drum sound.

(b) Reproduction of bass part B

In step Se2, It is judged whether or not the value of the register SWN(1) is equal to "2". In other words, it is judged whether or not the switching operation (1.e., operation of the switch 6-6), which designates the turn-off state for the bass part B, is made. If the switch 6-6 is not operated, a result of the judgement in step Se2 turns to "NO", so that the processing proceeds to step Se3. In step Se3, the data concerned with the bass part B (i.e., the aforementioned timing TM and keycode KC, see FIG. 3(D)) are read out in accordance with the values of the pointer DP. When the value of the timing TM coincides with the value of the register TMNG, the keycode KC is subjected to tone-pitch conversion in accordance with tile root of chord RT and the type of chord TP. Then, the keycode KC whose tone pitch has been converted is supplied to the tone generator 9. Thus, the tone generator 9 produces the bass sounds in response to the chord progression. Incidentally, when the switching operation to designate the turn-off state for the bass part B is made, the result of the judgement in step Se2 turns to "YES", so that the processing jumps to step Se4. In that case, the reproduction of the bass part B is not carried out.

(c) Reproduction of chord-backing part CB

Next, when the processing of the CPU 1 proceeds to step Se4, it is judged whether or not the value of the register SWN(2) is equal to "2". In other words, it is judged whether or not the switching operation designating the turn-off state for the chord backing part CB (i.e., operation of the switch 6-7) is made. If the switch 6-7 is operated, a result of the judgement in step Se4 turns to "YES". In that case the, remaining processes of the routine of the reproducing process (i.e., processes of steps Se5 to Se7) are omitted. On the other hand, when the switching operation designating the turn-off state for the chord backing part CB is not carried out, the processing proceeds to step Se5 from step Se4. In step Se5, the data concerned with the backing pattern BACK selected (i.e., the aforementioned timing TM and keycode KC, see FIG. 3(F)) are read out in accordance with the values of the pointer CP. When the value of the timing TM coincides with the value of the register TMNG, the keycode KC is subjected to tone-pitch conversion in accordance with the root of chord RT and the type of chord TP. Then, the keycode KC whose tone pitch has been converted is supplied to tile tone generator 9. Thus, the tone generator 9 can reproduce the chords for the rhythmic accompaniment in accordance with the chord progression.

In step Se6, it is judged whether or not the value of the register SWN(2) is equal to "0". In other words, it is judged whether or not the switching operation to designate the reproduction for the backing pattern CB together with the obbligato pattern OBLG (i.e., operation of the switch 6-7) is carried out. If the switch 6-8 designating the reproduction of the backing pattern BACK only is operated, a result of the judgement in step Se6 turns to "NO", so that the processing escapes from the routine of reproducing process. On the other hand, when the switch 6-7 is operated, the result of the judgement in step Se6 turns to "YES", so that the processing proceeds to step Se7.

In step Se7, the data concerned with the obbligato pattern OBLG selected (i.e., the aforementioned timing TM and keycode KC, see FIG. 3(G)) are read out in accordance with the values of the pointer OP. When the value of the timing TM coincides with the value of the register TMNG, the keycode KC is subjected to tone-pitch conversion in accordance with the root of chord RT and the type of chord TP. Then, the keycode KC whose tone pitch has been converted is supplied to the tone generator 9. Thus, the tone generator 9 can reproduce the chords for the melodic accompaniment in accordance with the chord progression.

⑨ Variation of Automatic Performance Responding to Each Event

Next, the other operations of tile automatic performance apparatus will be described with respect to the case where each of the aforementioned events is occurred during the automatic performance. In order to simplify the description, before starting the automatic performance, the specific performance style has been already selected in response to the aforementioned style-selection-switch event (see paragraph ②); hence, the specific chord progression pattern fitted with the selected performance style has been set up, while the value of the pointer has been also set up to designate the read-out addresses for each of the parts corresponding to the selected performance style. In such precondition, when the start/stop switch SS is operated, the automatic performance is started as described in paragraph ⑥.

When the automatic performance is started, when the combination switch CS is further operated, a specific combination between the chord progression pattern and each of the parts (i.e., each of the drum part, bass part and chord-backing part) is established at random. This leads the automatic performance into the unique accompaniment manner. In this case, the chord progression is changed to be suitable for the selected performance style. For example, when the switch 6-11 is operated while the automatic performance is proceeding in accordance with the aforementioned chord progression pattern "1", the chord progression pattern to be currently performed is changed to another chord progression pattern "2" as described in paragraph ⑤.

In the above-mentioned state, when the variation switch VS is further operated, the read-out addresses are set for the pointers DP, BP, CP and OP respectively as described in paragraph ④. For example, when the switch 6-6 within the variation switches VS is operated, the reading operation for the bass part B is stopped, so that the reproduction of the bass sounds in the automatic performance is stopped. On the other hand, when the switch 6-8 is operated, the reading operation for the obbligato pattern OBLG is stopped, so that the accompaniment manner is changed such that the rhythmic accompaniment using the chords is performed on the basis of the backing pattern BACK only.

D. Modifications

According to the present embodiment as described heretofore, a plurality of chord progression patterns which are suitable for each of the performance styles are provided; and then, one of them can be arbitrarily selected. Thus, even if the performance style is changed during the automatic performance, it is possible to continuously play the automatic performance using the selected chord progression pattern which is fitted with the changed performance style. Therefore, by use of the automatic performance apparatus according to the present invention, every performer can easily play the automatic performance even if the performer is a music beginner or the performer does not have a detailed knowledge for of chord-progression technigue. Particularly, just after the performer turns on the style selection switch ST so as to change the performance style, one of the chord progression patterns which is the most suitable for the changed performance style (in other words, one of tile chord progression pattern which is given the highest priority with respect to the changed performance style) is automatically selected, so that the chord performance optimum to the performance style can be designated with a simple switching operation. Moreover, a plurality of chord progression patterns are predetermined for each of the parts in connection with each of the performance styles. Therefore, by merely selecting the performance style, it is possible to automatically designate a desired chord progression pattern adequate to the automatic performance. This enables a musically advanced automatic performance for every user. Furthermore, by using the aforementioned combination switch CS, it is possible to establish a desired combination between the chord progression pattern and each of the parts with a single switching operation. Thus, it is possible to impart several kinds of variations to the automatic performance.

In the automatic performance apparatus according to the present embodiment, there are provided the style selection switch ST and the variation switch VS independently. Instead, it is possible to re-design the present embodiment such that a common switch sharing the functions of those switches ST and VS is provided. In this case, by changing over the function of that common switch, it is possible to selectively use one of the functions of the switches ST and VS.

The present embodiment provides the switch 6-12 which is used to limit the chord progression pattern to that using the chord of C major. The function of the switch 6-12 can be redesigned such that one of the chord of C major and a certain minor chord is selected. In this case, it is possible to select one of the chord of C major and minor chord in accordance with the performance style which is currently selected. Further, a transposition switch can be newly employed so as to transpose the tone pitch. In the present embodiment, a predetermined set of chord progression patterns are used for each of the performance style. However, it is possible to re-design the present embodiment such that the user can register a plurality of chord progression patterns with respect to each of the performance styles.

In the present embodiment, one major chord progression pattern and one minor chord progression pattern are selected as the chord progression patterns adequate to each performance style. However, the number of the chord progression patterns to be provided with respect to each performance style is not limited to two. Therefore, it is possible to re-design the present embodiment such that a plurality of chord progression patterns are provided and they are given priorities respectively. In this case, one of the chord progression patterns is selectively used by referring to the priorities with respect to each performance style.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An automatic performance apparatus comprising:

performance style designating means for designating a desired performance style from among a plurality of performance styles;

storage means for storing a chord progression pattern with respect to each of said plurality of performance styles;

read-out means for accessing said storage means to read out said chord progression pattern concerned with the desired performance style which is designated by said performance style designating means;

chord controlling means that is actuatable for overriding said chord progression that is read out of said storage means and designating a specific chord to be used as said chord progression; and automatic performance means for playing an automatic performance in accordance with said chord progression pattern.

2. An automatic performance apparatus comprising:

performance style designating means for designating a desired performance style from among a plurality of performance styles;

storage means for storing a plurality of chord progression patterns with respect to each of said plurality of performance styles;

chord-progression-pattern designating means for designating one of said plurality of chord progression patterns concerned with the desired performance style which is designated by said performance style designating means;

read-out means for accessing said storage means to read out the chord progression pattern designated by said chord-progression-pattern designating means in connection with the desired performance style;

chord controlling means that is actuatable for overriding said designated chord progression that is read out of said storage means and designating .a specific chord to be used as said chord progression; and automatic performance means for playing an automatic performance in accordance with the chord progression pattern.

3. An automatic performance apparatus comprising:

performance style designating means for designating a desired performance style from among a plurality of performance styles;

storage means for storing a plurality of chord progression patterns with respect to each of said plurality of performance styles, said storage means also storing priorities each of which is assigned to each of said plurality of chord progression patterns;

read-out means for accessing said storage means to read out a first chord progression pattern given the highest priority from among said plurality of chord progression patterns concerned with the desired performance style which is designated by said performance style designating means;

manual operation means, which is manually operated by a performer, for producing a switching instruction in response to a manual operation applied thereto;

read-out control means for controlling said read-out means such that, when receiving said switching instruction, the chord progression pattern currently designated is switched over from said first chord progression pattern to a second chord progression pattern which is automatically selected from said plurality of chord progression patterns, so that said read-out means accesses said storage means to start reading out said second chord progression pattern instead of said first chord progression pattern; and automatic performance means for playing an automatic performance in accordance with the chord progression pattern which is currently read from said storage means by said read-out means.

4. An automatic performance apparatus comprising:

performance style designating means for designating a desired performance style from among a plurality of performance styles;

chord storing means for storing a plurality of chord progression patterns with respect to each of said plurality of performance styles;

performance-pattern storing means for storing a plurality of performance patterns with respect to each of said plurality of performance styles;

random selecting means, which is manually operated by a performer, for selecting one of said plurality of chord progression patterns at random and also selecting one of said plurality of performance patterns at random in connection with the desired performance style which is designated by said performance style designating means;

read-out means for accessing said chord storing means and said performance-pattern storing means respectively to read out the chord progression pattern and the performance pattern which are selected by said random selecting means; and automatic performance means for playing an automatic performance in accordance with the performance pattern, read by said read-out means, by use of the chord progression pattern read by said read-out means.

5. An automatic performance apparatus comprising:

performance style designating means for designating a desired performance style from among a plurality of performance styles which are determined in advance;

performance-pattern storing means for storing a plurality of performance patterns with respect to each of a plurality of musical parts respectively corresponding to a plurality of musical instruments to be simulated;

selecting means for automatically selecting one of said plurality of performance patterns in connection with the desired performance style which is designated by said performance style designating means for each of said plurality of musical parts;

read-out means for accessing said performance-pattern storing means to read out the performance pattern which is selected by said selecting means for each of said plurality of musical parts; and automatic performance means for playing an automatic performance in accordance with the performance style which is read from said performance-pattern storing means by said read-out means.

6. An automatic performance apparatus as defined in claim 5 wherein said performance-pattern storing means contains a drum-part storage portion, a bass-part storage portion and a chord-progression storage portion corresponding to said plurality of musical parts, said drum-part storage portion storing drum performance patterns, said bass-part storage portion storing bass performance patterns, and said chord-progression storage portion storing chord progression patterns, so that said automatic performance means playing an automatic performance in accordance with a set of the drum performance pattern, bass performance pattern and chord progression pattern which are selected by said selecting means.

7. An automatic performance apparatus as defined in claim 5 wherein each of said performance styles corresponds to a specific music genre such as rock music, jazz and pop music.

8. An automatic performance apparatus comprising:

performance style designating means for designating a desired performance style from among a plurality of performance styles which are determined in advance;

performance-pattern storing means for storing a plurality of performance patterns with respect to each of parts respectively corresponding to musical instruments to be simulated;

selecting means for automatically selecting one of said plurality of performance patterns in connection with the desired performance style which is designated by said performance style designating means;

read-out means for accessing said performance-pattern storing means to read out the performance pattern which is selected by said selecting means; and automatic performance means for playing an automatic performance in accordance with the performance style which is read from said performance-pattern storing means by said read-out means wherein said performance-pattern storing means also stores predetermined priorities, and wherein each of the predetermined priorities is assigned to each of said plurality of performance patterns, so that said selecting means selects the performance pattern with a higher priority.

9. A method of automatically performing music, the method comprising the steps of:

designating a desired performance style from among a plurality of performance styles;

storing a plurality of chord progression patterns with respect to each of said plurality of performance styles;

storing priorities each of which is assigned to each of said plurality of chord progression patterns;

accessing the stored chord progression patterns to read out a first chord progression pattern given the highest priority from among said plurality of chord progression patterns concerned with the designated desired performance style;

producing a switching instruction in response to a manual operation of a switch operated by a performer;

controlling the accessing of the stored chord progression patterns such that, when receiving said switching instruction, the chord progression pattern currently designated is switched over from said first chord progression pattern to a second chord progression pattern which is automatically selected from said plurality of chord progression patterns, so that said accessing step is repeated to start reading out said second chord progression pattern instead of said first chord progression pattern; and playing an automatic performance in accordance with the chord progression pattern which is currently being accessed.

10. A method of automatically performing music, the method comprising the steps of:

designating a desired performance style from among a plurality of performance styles;

storing a plurality of chord progression patterns with respect to each of said plurality of performance styles;

storing a plurality of performance patterns with respect to each of said plurality of performance styles;

selecting one of said plurality of chord progression patterns at random and also selecting one of said plurality of performance patterns at random in connection with the designated desired performance style;

accessing the stored chord progression patterns and the stored performance-patterns respectively to read out the chord progression pattern and the performance pattern which are selected by said random selecting means; and playing an automatic performance in accordance with the read out performance pattern and by use of the read out chord progression pattern.

11. An automatic performance apparatus comprising:

a performance style designating device that designates a desired performance style from among a plurality of performance styles;

a memory storage device that stores a plurality of chord progression patterns with respect to each of said plurality of performance styles, the memory storage device also stores priorities each of which is assigned to each of said plurality of chord progression patterns;

a read-out device that accesses the memory storage device to read out a first chord progression pattern based upon a highest priority from among said plurality of chord progression patterns concerned with the desired performance style which is designated by said performance style designating device;

a manual operation switch, which is manually operated by a performer, that produces a switching instruction in response to a manual operation applied thereto;

a read-out control device that controls said read-out device such that, when receiving said switching instruction, the chord progression pattern currently designated is switched over from said first chord progression pattern to a second chord progression pattern which is automatically selected from said plurality of chord progression patterns, so that said read-out device accesses said memory storage device to start reading out said second chord progression pattern instead of said first chord progression pattern; and an automatic performance circuit that plays an automatic performance in accordance with the chord progression pattern which is currently read from said memory storage device by said read-out device.

12. An automatic performance apparatus comprising:

a performance style designating device that designates a desired performance style from among a plurality of performance styles;

a chord storage device that stores a plurality of chord progression patterns with respect to each of said plurality of performance styles;

a performance-pattern storage device that stores a plurality of performance patterns with respect to each of said plurality of performance styles;

a random selection switch, which is manually operated by a performer, that selects one of said plurality of chord progression patterns at random and one of said plurality of performance patterns at random in connection with the desired performance style which is designated by said performance style designating device;

a read-out device that accesses said chord storage device and said performance-pattern storage device respectively to read out the chord progression pattern and the performance pattern which are selected by said random selecting switch; and an automatic performance circuit that plays an automatic performance in accordance with the performance pattern, read by said read-out device, and by use of the chord progression pattern read by said read-out device.

* * * * *